US006832539B2

(12) United States Patent
Colby

(10) Patent No.: US 6,832,539 B2
(45) Date of Patent: Dec. 21, 2004

(54) CYLINDER LOCK

(75) Inventor: Douglas D. Colby, Clarkston, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 44 days.

(21) Appl. No.: 10/195,666

(22) Filed: Jul. 15, 2002

(65) Prior Publication Data

US 2004/0007127 A1 Jan. 15, 2004

(51) Int. Cl.[7] ..... F15B 15/22
(52) U.S. Cl. ..... 92/14; 92/20
(58) Field of Search ..... 92/20, 14, DIG. 4; 269/32

(56) References Cited

U.S. PATENT DOCUMENTS

| | | | | | |
|---|---|---|---|---|---|
| 2,333,274 | A | * | 11/1943 | Scannell | 92/14 |
| 3,576,151 | A | * | 4/1971 | Sendoykas | 92/24 |
| 4,635,536 | A | * | 1/1987 | Liu et al. | 92/24 |
| 5,081,910 | A | * | 1/1992 | D'Ascenzo, Jr. | 92/20 |
| 5,553,690 | A | * | 9/1996 | Takahashi | 188/300 |
| 5,761,984 | A | * | 6/1998 | Goellner et al. | 92/21 MR |
| 6,343,537 | B1 | | 2/2002 | Iida et al. | 92/13.1 |
| 6,343,538 | B1 | | 2/2002 | Skinner | 92/18 |
| 6,344,718 | B1 | | 2/2002 | Nagai et al. | 318/14 |
| 2001/0003388 | A1 | | 6/2001 | Takahashi et al. | 269/32 |

* cited by examiner

*Primary Examiner*—Edward K. Look
*Assistant Examiner*—Igor Kershteyn
(74) *Attorney, Agent, or Firm*—Dinnin & Dunn, P.C.

(57) ABSTRACT

A cylinder locking device for use in a clamp. The cylinder locking device includes a cylinder member and a first end cap on one end thereof and a second end cap on another end thereof. A piston is arranged within the cylinder member and a piston rod is engaged with the piston. The piston rod is capable of movement with respect to the piston. The cylinder rod lock device also includes a plunger contacting the second end cap. A spacer contacting the second end cap is also included in the locking device. The locking device also includes at least one locking arm contacting the spacer. The locking device also includes a mounting plate contacting the locking arm and a fastener on an opposite side thereof. The cylinder locking device will be capable of locking the cylinder in a fully retracted position and a fully engaged position.

29 Claims, 9 Drawing Sheets

CYLINDER LOCK

BACKGROUND OF THE INVENTION

1. Field of the Invention

The present invention generally relates to a cylinder, and more particularly relates to a locking device for use in a cylinder.

2. Description of Related Art

Cylinders have been used for many years and have been used in combination with clamps or power clamps for many years also. Generally, the cylinder includes a piston, a piston rod and a generally cylindrical body member. The body member has end caps on the end thereof and the body and piston normally include seals and bearings surfaces thereon. The cylinders operate by the input of a fluid or gaseous substance. The most frequently used fluids in the industry are air and oil, however other fluids have been known to be used and other gas substances have also been know to be used to operate a cylinder device. Generally, air cylinders are the preferred device to use in the prior art because of there relatively low cost and reduced maintenance schedule to keep the cylinder and hence clamp operating in the work environment.

The prior art includes many versions of a cylinder that are capable of being opened and closed and locked in various positions. There have been problems in the prior art with the cylinder device locks holding and maintaining a locked position due to the fact that the fluid within the cylinders is apt to leak no matter the design of the check valves and/or seals. Furthermore, pneumatic fluid is capable of losing pressure while in containment and thus reducing mechanical force on the cylinder device to zero and allowing for movement of the piston rod. Therefore, the prior art has difficultly in locking a cylinder device because of heat, high force and long periods of time which eventually lead to devices being released and the pay load dropped or left unsecured because of the pneumatic losses in the cylinder devices.

Many attempts have been made in the prior art to incorporate a cylinder with a braking device. Problems have been encountered in the prior art when the braking device must be released to move the cylinder because the release operation of the braking device generally requires mechanical input from either a second motor or second pneumatic system thus increasing the cost of the cylinder and braking mechanism and making it impractical for many applications. Furthermore, many of the prior art cylinder locking devices are positioned at the top end of the cylinder and allow for the locking of the cylinder when the rod is in its fully extended position. In some prior art mechanisms when the cylinder is in its fully extended position and locked, if a failure of the hydraulic system occurs the rod would be capable of movement. The cylinder could lose its air pressurization lock and allow for unwanted movement of the cylinder and hence movement of the part being held by the cylinder rod. Furthermore, when in the fully retracted position the prior art locking cylinders would not lock the rod in place and hence the rod is capable of movement which could effect the clamping device when the locking cylinder is off or not in use, such as during maintenance. This may result in no fluid pressure being within the locking cylinder device. This could lead to accidents or injuries of workers near the clamps because of the clamp arms falling and parts being dropped because the arm is not in a locked position when in it is fully retracted. Most of the prior art cylinder lock systems also require extra expense because a second hydraulic system is installed to control the locking mechanism and the operation of such locking mechanism. This increases the cost by increasing the number of apertures needed in the end caps and locking cylinder along with the extra parts needed to connect extra hydraulic hoses to the cylinder and the extra room needed to incorporate all these hoses in the extra hydraulic system. Furthermore, the second hydraulic systems as found in the prior art the main component unlocking the cylinder device thus if the second hydraulic system fails the cylinder device is not capable of being unlocked and extensive repairs must be made to unlock the cylinder. Furthermore, many of these prior art cylinder locking devices have complicated systems that require new parts to be made for the end caps and the cylinder as a package and also increases the foot print of the cylinder thus reducing the space available for manufacturing operational needs.

Therefore, there is a need in the art for a new cylinder locking device that is capable of locking the cylinder at both the back end and top end of the cylinder. There is also the need for a cylinder locking device that uses the main piston of the cylinder for the unlocking of the cylinder locking device. This will allow for only the main pneumatic system, used to move the piston, to be used to lock and unlock the cylinder. There is also a need in the art for a cylinder locking device that removes the need for an entire second hydraulic system to operate a cylinder locking device. There is also a need in the art for a low cost dual end locking cylinder device that reduces the complexity of building the cylinder device and the complexity of installing the cylinder locking device in a manufacturing environment. There also is a need in the art for a cylinder device that is capable of being used in a clamping environment and also in a pivot unit environment wherein locking is needed on either one end of a cylinder or both ends of the cylinder.

SUMMARY OF THE INVENTION

One object of the present invention is to provide an improved cylinder locking device.

Another object of the present invention is to provide a new cylinder locking device for use in a clamp.

Yet a further object of the present invention is to provide a cylinder locking device capable of being locked at both the top end and back end of a cylinder.

It is yet a further object of the present invention to provide a cylinder locking device that is capable of being used on either end of the cylinder.

It is yet a further object of the present invention to provide a cylinder locking device that uses the main piston of the cylinder as the unlocking mechanism of the locking device.

It is still a further object of the present invention to provide a cylinder locking device that requires only one hydraulic system wherein a second hydraulic system is not needed to operate the locking device for the cylinder rod.

It is a further object of the present invention to provide a cylinder locking device for a clamp wherein only two ports are needed to operate the hydraulic system of the clamp and locking device.

It is still a further object of the present invention to provide a low cost and nearly maintenance free locking device for a cylinder.

To achieve the fore going objects, a cylinder lock for use in the cylinder is disclosed. The cylinder lock includes a rod and a sleeve arranged around the rod. A circular disc having an orifice therethrough with the sleeve arranged within the orifice. The cylinder lock also includes at least one locking member attached to the cylinder disc on one side thereof. The locking member interacts with the rod when the rod is in a locked position.

One advantage of the present invention is that the cylinder locking device includes a locking mechanism at both the top end and back end of the cylinder.

A further advantage of the present invention is that the cylinder locking device uses the main piston of the cylinder for the unlocking of the locking mechanism.

Still another advantage of the present invention is that the cylinder only includes the two main hydraulic ports to operate both the piston and the locking mechanism.

Still a further advantage of the present invention is that only one pneumatic system is needed to operate both the piston and the locking mechanism.

Still another advantage of the present invention is that the cylinder locking device can be used in just one end of the cylinder.

Another advantage of the present invention is that it reduces the cost and external connections for a cylinder locking device in the manufacturing environment.

Still another advantage of the present invention is that the cylinder locking device becomes nearly maintenance free and is also capable of design modifications due to predetermined angles on the cylinder rod and locking member.

Other objects, features and advantages of the present invention will become apparent from the subsequent description and appended claims, taken in conjunction with the accompanying drawings.

DESCRIPTION OF THE EMBODIMENT(S)

Figure 1:
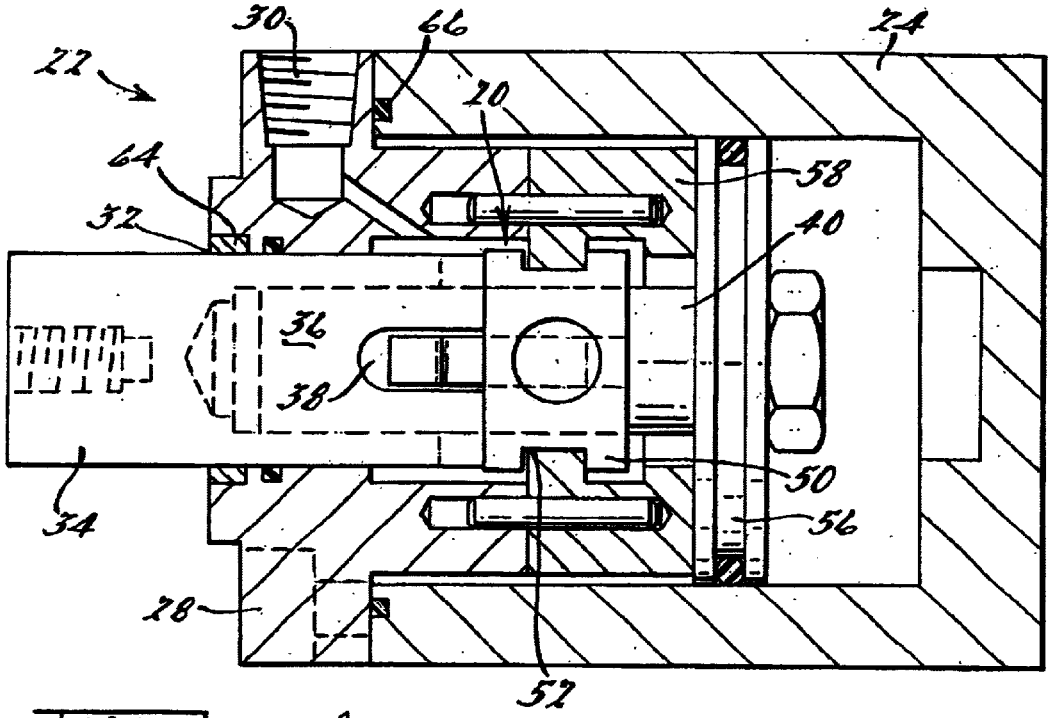
FIG. 1 shows a cross section of one embodiment of a cylinder locking device according to the present invention.

Referring to the drawings, a cylinder locking device 20 according to the present invention is shown. It should be noted that the cylinder locking device 20 can be used in any type of cylinder. In the embodiments disclosed herein the cylinder locking device 20 is used in a clamping environment or a pivot unit environment wherein the cylinder locking device 20 will lock a clamp in either a fully retracted position or a fully extended position. The clamp may be a power clamp or a traditional toggle link clamp and may be used for any number of applications such as manufacturing or other types of clamping operations such as holding doors closed on vacuum systems, etc. The present invention includes a novel method of locking a cylinder at either the top or back end or both of a cylinder in a clamp environment.

Figure 2:
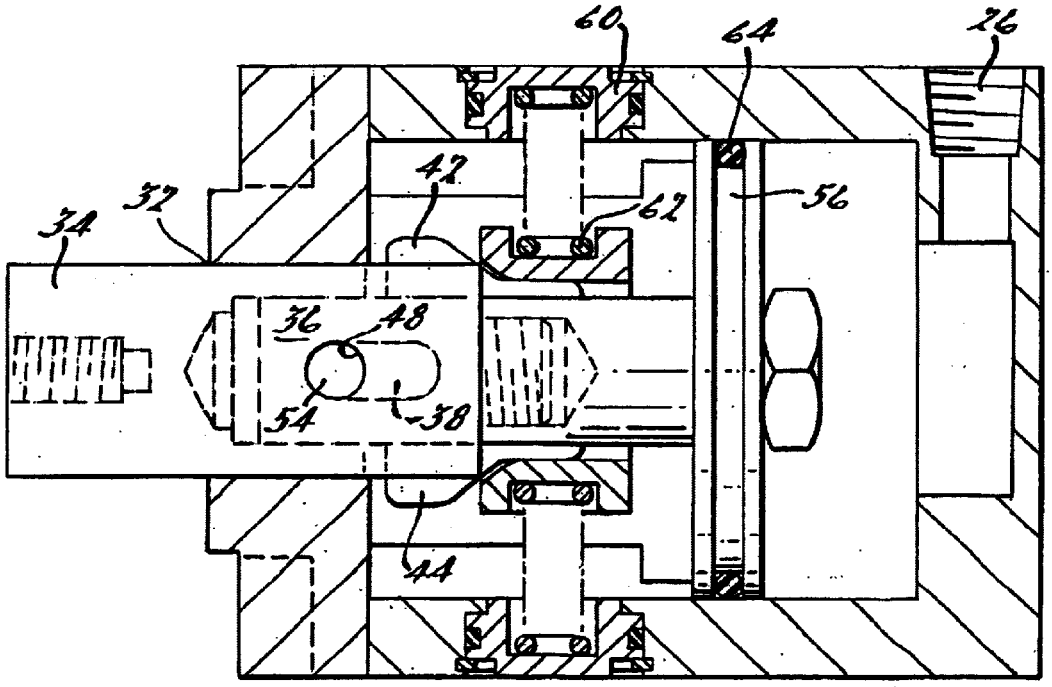
FIG. 2 shows a cross section of the cylinder locking device of FIG. 1 along another axis.
Figure 3:
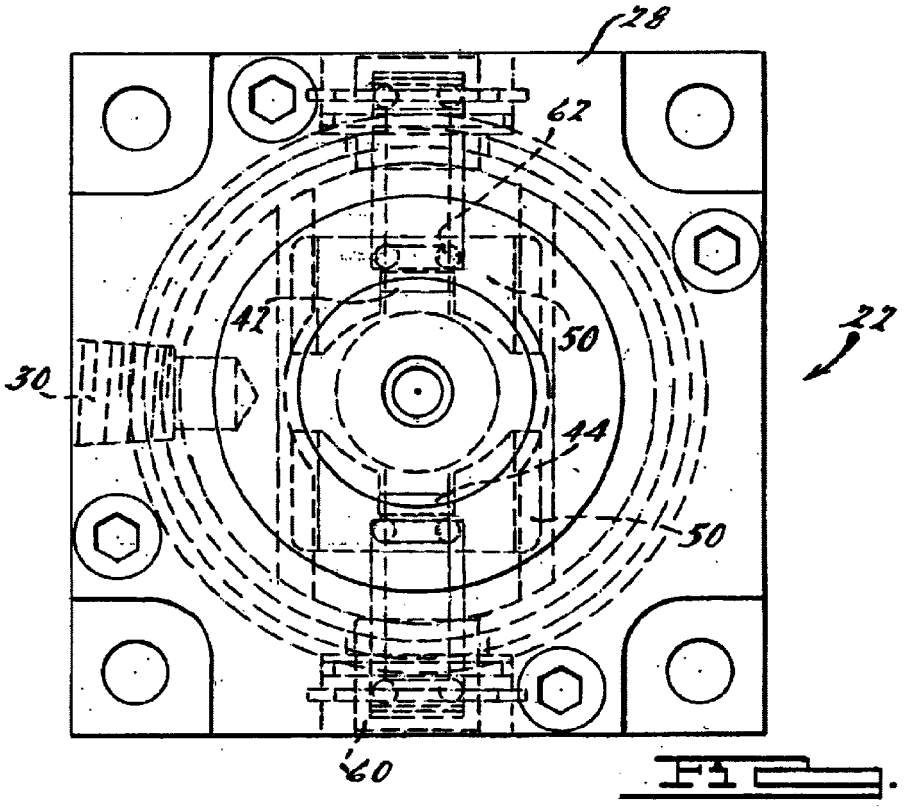
FIG. 3 shows an end view of the cylinder locking device according to FIG. 1.

FIGS. 1 through 3 show one embodiment of the cylinder locking device 20 according to the present invention. In this embodiment the cylinder locking device 20 is used in a pancake cylinder 22 which are generally used for soft but firm holds generally on plastic products and small device manufacturing and the like. As shown in FIGS. 1 through 3 the pancake cylinder 22 generally includes a body 24 which has a cup like shape in cross section. The body 24 has a pneumatic orifice 26 at one end thereof to allow for the entrance or exit of pressurized fluid or gas. A cradle or end cap 28 is secured to the open end of the body 24. The end cap 28 also includes a pneumatic orifice 30 therein which allows for pressurized fluid or gas to enter the opposite end of the pancake cylinder 20. The cradle 28 also includes an orifice 32 at a center point thereof through which a ram member 34 extends. The ram member 34 is used to connect to a holding device or is used to hold the plastic or small products in place for manufacturing operations. The ram member 34 has a hollow bore 36 on one end thereof and also includes an oblong shaped channel 38 through an entire diameter thereof. Slidingly located within the ram bore 36 is a piston rod 40 that has a first 42 and second appendage 44 extending from and on opposite sides therefrom, respectively. The appendages 42, 44 generally have a predetermined angled surface such that it is capable of opening and closing a locking mechanism. The piston rod 40 also includes a circular orifice 48 through an entire diameter thereof. Arranged around an outer surface of the piston rod 40 is a locking key 50 which generally has a cylindrical shape with a circumferential notch 52 around an outer surface thereof. A pin 54 is used to connect the piston rod 40 to the ram 34 such that the piston rod 40 is capable of axial movement relative to the ram 34. The relative axial movement is predetermined and defined by the length of the oblong orifice 38 through the ram diameter. The piston rod 40 is connected by any known means to a piston 56 which is arranged within a bore of the body 24. The piston 56 is capable of axial movement within the cylinder body 24. A guide rail 58 is engaged with one side of the piston 56 and also surrounds the piston rod 40. The guide rail 58 interacts with the outer circumferential channel on the locking key 50. A spring retainer 60 is located in a side wall of the body 24 and includes a spring 62 between the body wall and the spring retainer 60 to urge the spring retainer 60 in an inner radial direction. The spring 62 engages with the locking key 50 to lock the cylinder 22 when it is in its fully engaged position. The locking key 50 will engage with the backend of the ram 34 for locking of the cylinder in its fully engaged position.

In operation the pancake cylinder 22 starts in its fully retracted position and then when a part is to be held by the pancake cylinder air is applied to the pneumatic orifice 26 in the body 24 which increases the pressure on the piston 56 and moves the piston 56 in an axial direction towards an engaged fully opened position. In its fully retracted rest position the locking key 50 is resting on the widest radius of the angled appendages 42, 44 on piston rod 40. When the piston rod 40 begins movement the locking key 50 will slide down the decreasing radius until the locking key 50 engages with the end of the ram 34. When the operation has been performed on the plastic part or small part being held by the pancake cylinder 22, the air pressure will be slowly released from the hydraulic orifice 26 on the body 24 and air pressure will be introduced to the hydraulic orifice 30 on the cradle 28. This will allow for movement of the piston 56 and hence piston rod 40. The piston rod 40 will begin its axial movement before that of the ram 34 thus allowing for the piston rod 40 to have its predetermined angled appendages 42, 44 engage with the locking key 50 and move the locking key 50 in a radial extended direction, by the increased angle on the piston appendages 42, 44. This will allow for the locking key 50 to clear the radius of the ram 34 and to be placed in its unlocked static position before the pin 54 reaches the end of the oblong orifice 38 thus allowing the ram member 34 to move free and clear in an axial direction from the locking key 50 once the piston rod 40 reaches the end of the oblong channel 38. Then the piston 56 will be moved back to its fully retracted position and the locking key 50 will be in a static/equilibrium position at the largest outer diameter of the appendages 42, 44 extending from the piston rod 40. It should be noted that appropriate seals 64 are located on the outer circumference of the piston 56 and between the ram member 34 and the end of the cradle 28. It should also be noted that there is a seal 66 between the cradle 28 and the body 24 to allow for a hydraulic system. All of the described parts, other then the seals, are generally made of a metal material however any other hard substance such as composites, ceramics, plastics etc., may also be used.

Figure 4:
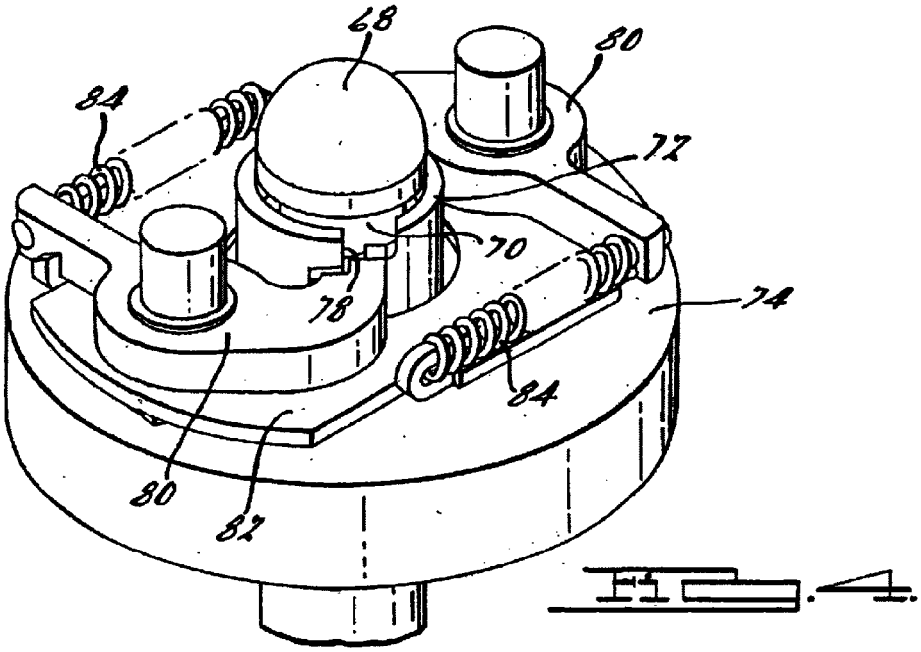
FIG. 4 shows a perspective view of the cylinder locking device according to another embodiment.
Figure 5:
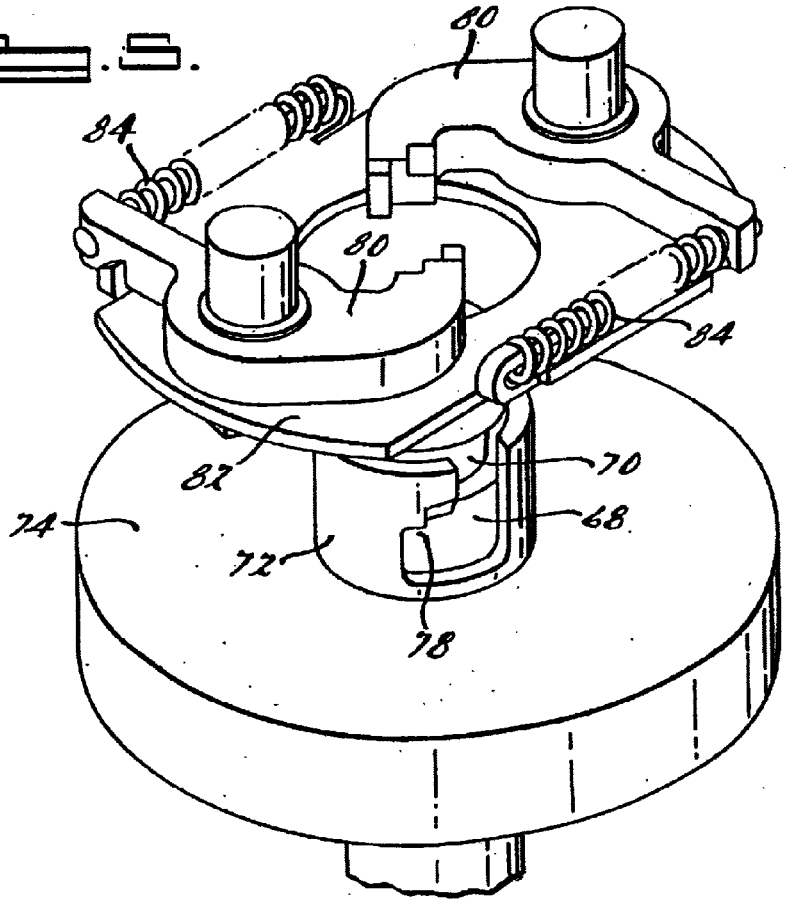
FIG. 5 shows an exploded view of the cylinder locking device of FIG. 4.
Figure 6:
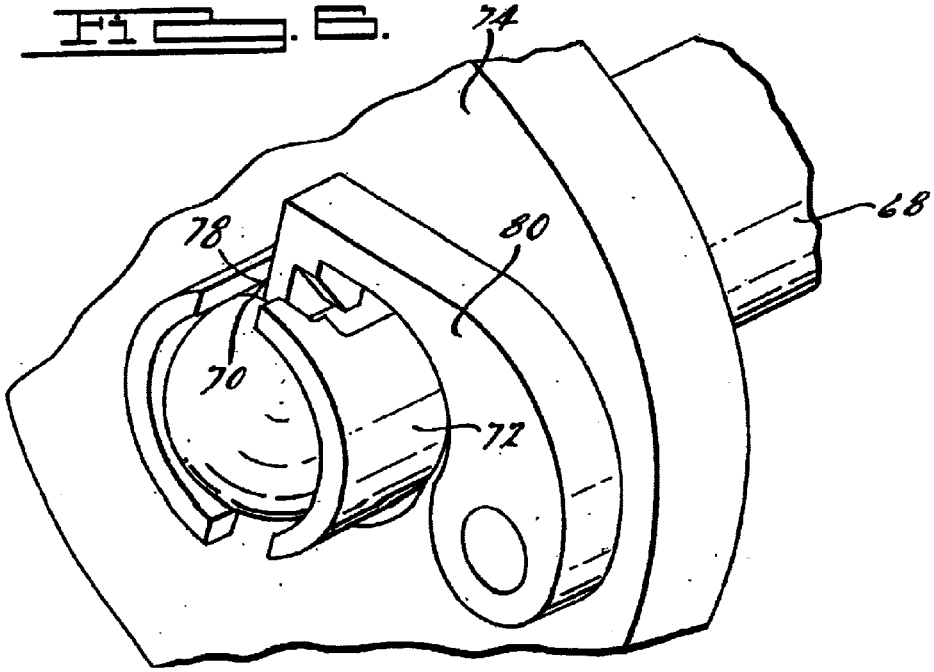
FIG. 6 shows a cylinder locking device in perspective locking a cylinder rod.
Figure 7:
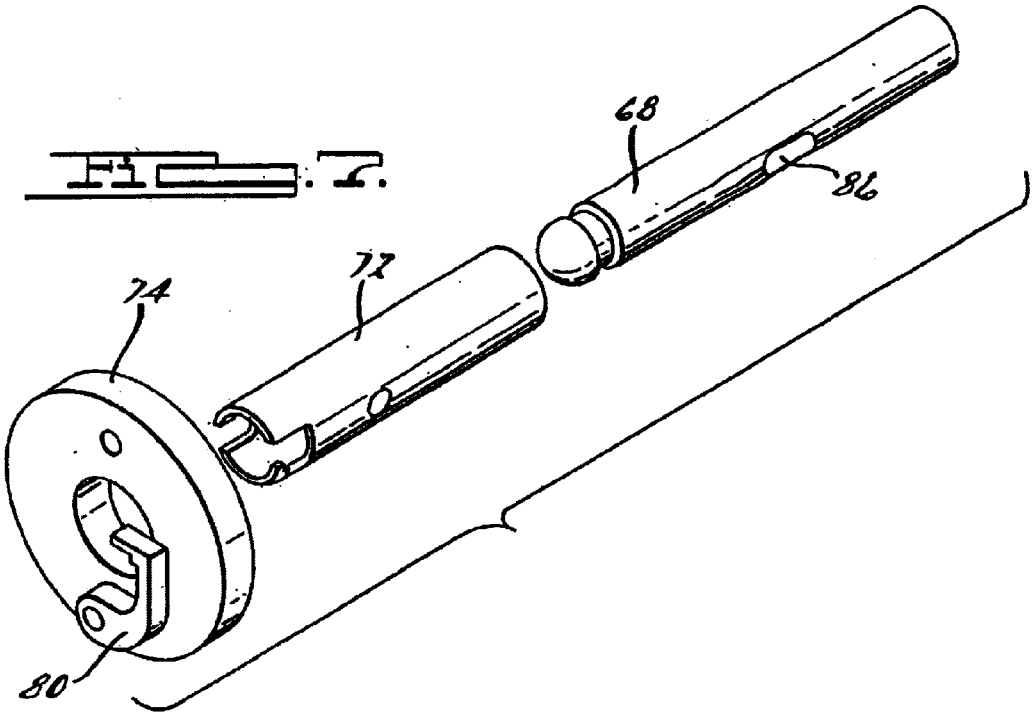
FIG. 7 shows an exploded view of the piston rod, sleeve and piston according to FIG. 4.
Figure 8:
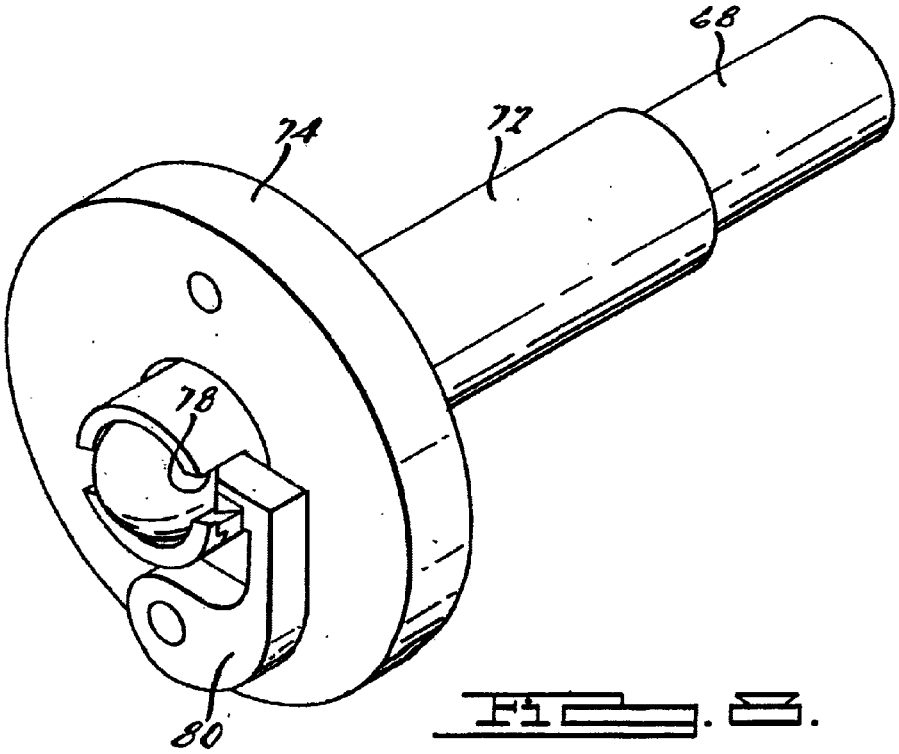
FIG. 8 shows a perspective view of the cylinder rod locking device according to FIG. 4.
Figure 9:
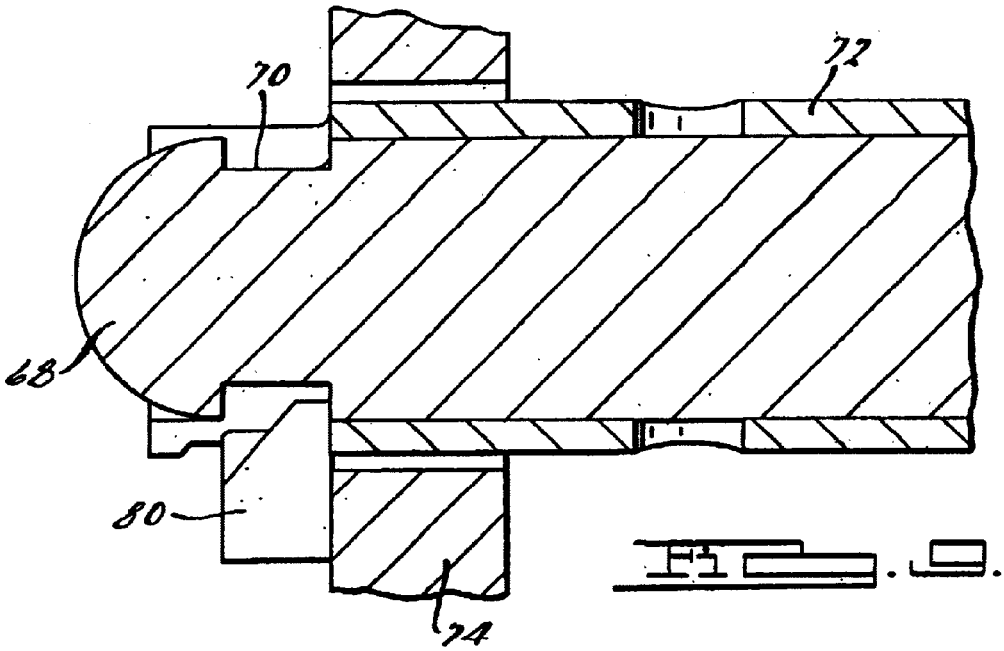
FIG. 9 shows a cross section of the cylinder locking device of FIG. 8.
Figure 10:
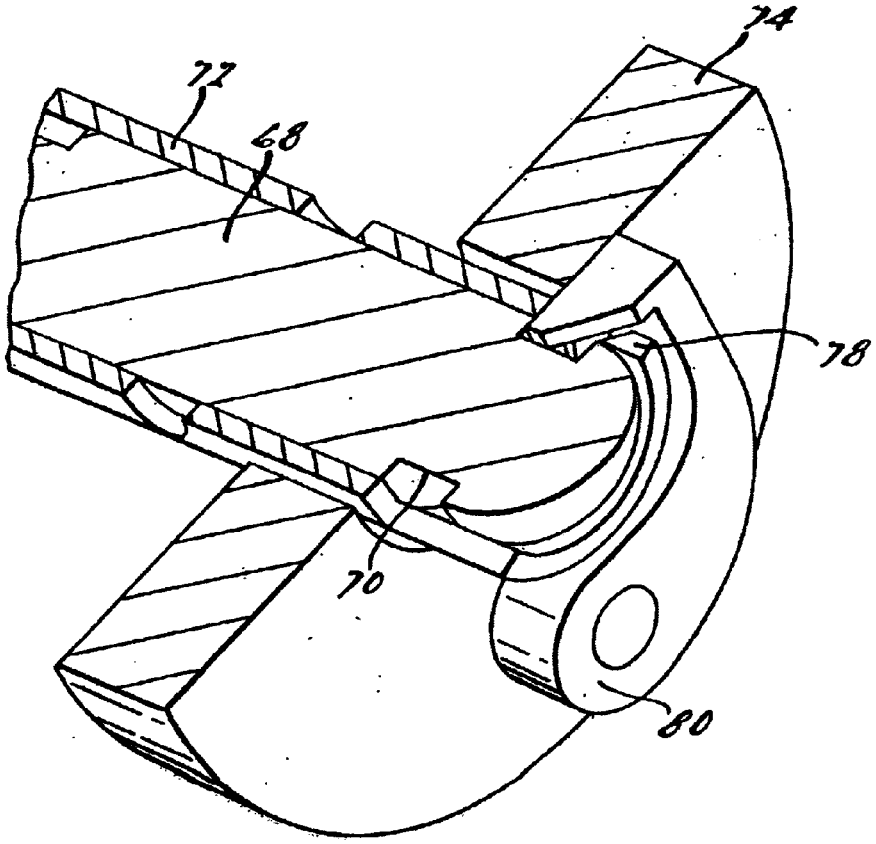
FIG. 10 shows a second cross section of the cylinder locking device according to FIG. 8.
Figure 11:
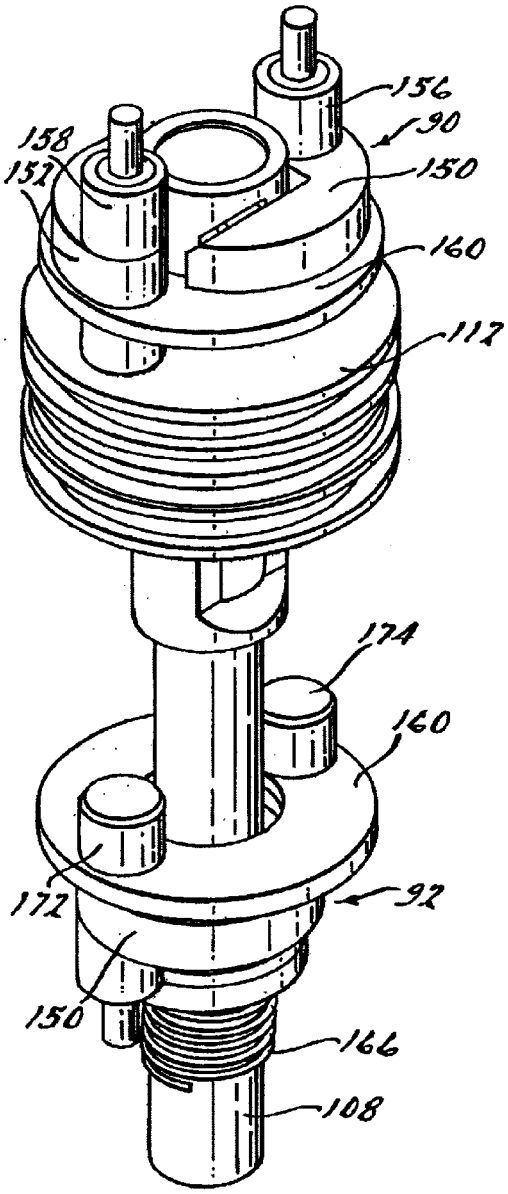
FIG. 11 shows a perspective view of a cylinder locking device according to an alternate embodiment.
Figure 12:
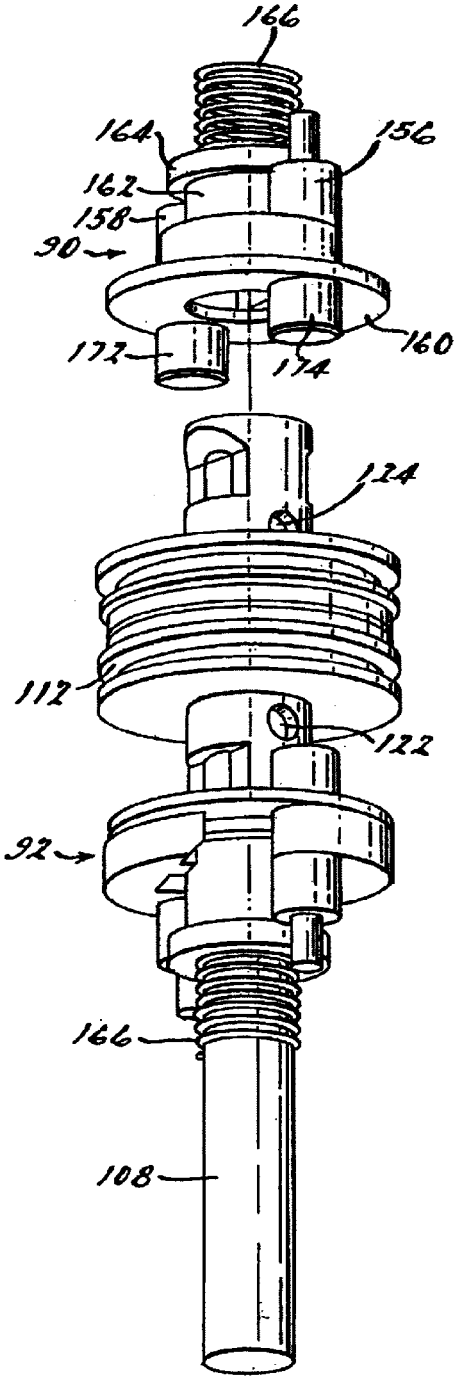
FIG. 12 shows an exploded view of the alternate embodiment of the cylinder locking device of FIG. 11.

FIGS. 4-10 show another embodiment of the cylinder locking device 20 that may be used in a pancake cylinder or in any other type of cylinder for a clamp environment. The piston rod 68 is shown having a circumferential notch 70 near one end thereof. The cylinder rod 68 is slidingly movable within a piston sleeve 72 which is either integral with a piston 74 as shown in FIG. 4 or a separate sleeve as shown in FIG. 6. The piston sleeve 72, whether a separate device or integral with the piston 74, is secured to the piston 74 such that axial movement of the piston 74 will create axial movement of the piston sleeve 72, also. The piston sleeve 72 includes a pair of circular orifices 76 through a side thereof and across from one another. Also at one end of the piston sleeve 72 is at least one generally L-shaped notch 78 but in this embodiment they are located on both sides of the piston sleeve 72 such that they are 180° from one another. The notch 78 includes an angled surface near the top end thereof. This angled surface will interact with an angled surface on a locking arm 80 which is connected to either a separate plate 82 as shown in FIG. 4 or to the piston 74 as shown in FIG. 6. The locking arm 80 is capable of rotational movement around a pre-defined axis. As shown in FIG. 4 the locking arm 80 has a spring 84 connected between one end of the locking arm 80 and the mounting plate 82. This will allow for the spring 84 to urge radial movement of the end of the locking arm 80 in towards the cylinder rod locking shoulder. As shown in FIG. 4 a second locking arm may be mounted directly across from the first locking arm 80 such that the pivot points have 180° of separation. This will allow for a stronger locking mechanism and reduce the risk of an unexpected lock failure. It should be noted that the piston rod 68 has an oblong channel 86 through a diameter thereof and interacts with the circular orifice 76 in the sleeve 72 such that the piston rod 68 has axial movement relative to the piston sleeve 72 and piston 74 which will allow for the locking arm 80 to engage the angled surface of the piston sleeve 74 and thus disengage itself from the piston rod channel 70 before any axial movement of the piston rod 68 occurs. The operation of this embodiment works in the same general way as described above. The materials used are also similar to those used for the above described embodiment.

FIGS. 11-19 show a second alternate embodiment of the cylinder locking device 20 according to the present invention. In the second embodiment the cylinder locking device 20 includes a first 90 and second locking system 92 located on both the back end and top end of the cylinder 94. It should be noted that the dual cylinder locking mechanism may be used in any type of cylinder including the pancake cylinder and also can be used in any other power clamp, toggle clamp or other clamping mechanism along with any pivot unit mechanisms that use a cylinder to perform any type of rotary or linear motion. It should further be noted that the locking mechanism used in the dual lock cylinder can be designed such that only one of the locking mechanisms is placed in the top end and/or back end of the cylinder 94 thus creating just a single cylinder lock instead of the dual cylinder lock mechanism as shown.

As shown in the figures a cylinder body 96 generally having a cylindrical shape with a hollow bore is shown. A first end cap 98 is connected to one end of the cylinder body 96. The first end cap 98 includes a pneumatic orifice 100 therein that will allow for pressurized gas or fluid to enter the cylinder 94 at the back end. On the opposite end of the cylinder 94 is located a second end cap 102 which also includes a pneumatic orifice 104 therein such that pressurized gas or fluid may be introduced at the top end of the cylinder 94. The second end cap 102 also includes an orifice 106 therethrough which will allow a piston rod 108 to extend from the cylinder 94 through the second end cap 102 and onto a hold down or other holding device for use in the clamping environment. Appropriate seals 110 surrounding the piston rod 108 are located between the piston rod 108 and the end cap 102 such that the pneumatic environment may be maintained within the cylinder environment.

A piston 112 is arranged within the bore of the cylinder 94 and includes a plurality of seals and bearings 114 between the inner cylinder bore wall and the outer surface of the piston 112. This will allow for movement of the piston 112 relative to the pressure being introduced on either end of the piston 112. The piston 112 also includes a first sleeve 116 and a second sleeve 118 extending from each end thereof. The piston 112 generally has a circular bore 120 through a mid point. The sleeve 116, 118 in port generally form a cylindrical shaped extension. It should be noted that in another contemplated embodiment a cylindrical shaped sleeve may be inserted into an orifice of a piston 112 and secured by any known means such as welding to the piston, but in the embodiment shown the cylindrical sleeve includes a first 116 and second sleeve portion 118 which are integral to and machined into the piston 112 directly. The sleeves 116, 118 include a first 112 and second circular orifice 124 through a diameter thereof, it should be noted that any other shaped orifice can be used. The piston 112 also includes a seal 126 located on the inner surface of the piston 112 such that the piston rod 108 has a complete seal between the inner surface of the sleeve/piston and the outer surface of the piston rod 108. The piston sleeve 116, 118 also includes on each end thereof a first 128 and second orifice 130 directly across or 180° away from each other. The orifice 128,130 includes a flat radial shoulder surface 132 on the inner edge of the orifice 128, 130 and an angled surface 134 on the outer edge of the orifice 128, 130. The outer angled edge 134 will interact with a locking arm surface to allow for locking of the piston rod 108. The exact same set of orifices are located on the opposite end of the piston sleeve. It should be noted that the piston sleeve, piston, piston rod, end caps, and cylindrical body are generally made of a metal material but any other hard composite, plastic, ceramic material, etc. may also be used if it is capable of withstanding the necessary forces.

Arranged within the piston 112 and piston sleeve 116, 118 is a piston rod 108. The piston rod 108 will extend through the second end cap 102 and into the work environment of the clamp. The piston rod 108 generally has a cylindrical shape that includes a first 136 and second oblong shaped channel 138 through an entire diameter thereof. The length of the oblong shaped channel 136, 138 will determine the relative axial movement between the piston rod 108 and the piston 112. A pin 140 will be used to connect the piston rod 108 to the piston sleeve 116, 118 via the orifices 122, 124 in the piston sleeve 116, 118 and the oblong channels 136, 138 through the piston rod 108. The piston rod 108 includes a first 142 and second notch 144 on one end thereof and a third 146 and fourth notch 148 located a predetermined distance from the first and second notches 142, 144. These notches generally will have radial edges on them such that they will interact and form a locking shoulder with a surface of the locking arm 150. It should be noted that if only one locking arm 150 is to be used only one notch will be needed at each location. But in the embodiment shown a first 142 and second notch 144 are needed because a first 150 and second locking arm 152 are used to hold the piston rod 108. Both the piston 112 and piston rod 108 are capable of axial movement within the cylinder 44. It should further be noted that the piston rod 108 is capable of axial movement relative to the piston 112 and piston sleeve 116, 118 a predetermined amount, equal 40 to that of the length of the oblong channel 136 in the piston rod 108. It should be noted that in this embodiment the piston rod 108 is rotationally fixed with respect to the piston 112 and thus is not capable of rotational movement. However, in other contemplated embodiments the piston rod 108 will be capable of rotational movement relative to the piston 112 or the cylindrical body 96 and thus allow for a rotary motion clamping action.

A first locking system 90 is connected to the inner surface of the first end cap 98. The first locking system 90 includes a first 156 and second spacer 158 in contact with an inner surface of the first end cap 98. A first 150 and second locking arm 152 are in contact with the opposite end of the first 156 and second spacer 158, respectively. The first and second locking arm 150, 152 are capable of rotational motion along an axis through the center point of both the spacer 156, 158 and the locking arms 150, 152. A mounting plate 160 is connected to the outer surface of the first 150 and second locking arms 152. The mounting plate 160 generally has a circular shape with an orifice through the middle portion thereof. A plunger 162 which generally has a cylindrical shape is in sliding engagement with the first 150 and second locking arm 152 and the first 156 and second spacer 158. The plunger 162 includes an appendage 164 extending from one end thereof that has a greater radius. The increased radius appendage 164 of the plunger 162 generally is in contact with a surface of the first end cap 98. The plunger 162 is capable of axial movement along the axis of the piston rod 108. The piston rod 108 will slide through the internal bore of the plunger 162. A spring 166 is located between the first end cap 98 and an inner shoulder portion of the plunger 162. The spring 166 will urge the plunger 162 in an axial direction towards the piston 112. A second 168 and third spring 170 are connected between the mounting plate 160 and the first 150 and second locking arms 152, respectively. The springs 168, 170 will urge the locking arms 150, 152 in an inner radial direction. A first 172 and second fastener 174 will secure the locking system 90 to the inner surface of the first end cap 98. A shoulder bolt or screw is the fastener in this embodiment and is in contact with the mounting plate 160 on one end thereof and, via its threads, to a first and second orifice in the inner surface of the first end cap 98.

As shown, a second locking system 92 is attached to the inner surface of the second end cap 102 in the same arrangement as that described for the first locking system 90. The only difference is that the plunger 162 is arranged around the outer circumference of the piston rod 108 at all times. When the first or second locking system 90, 92 is in a static or non-locking mode the plunger 162 will be urged and moved such that the plunger 162 will engage the first 150 and second locking arms 152 and hold the first 150 and second locking arms 152 in an open non-equilibrium position. It should be noted that one or other of the locking systems does not have to be included in the locking cylinder but in this embodiment a first 90 and second locking system 92 is preferred. A plurality of seals will seal the first end cap 98 and second end cap 102 to the cylinder body such that a pneumatic system is possible.

Figure 13:
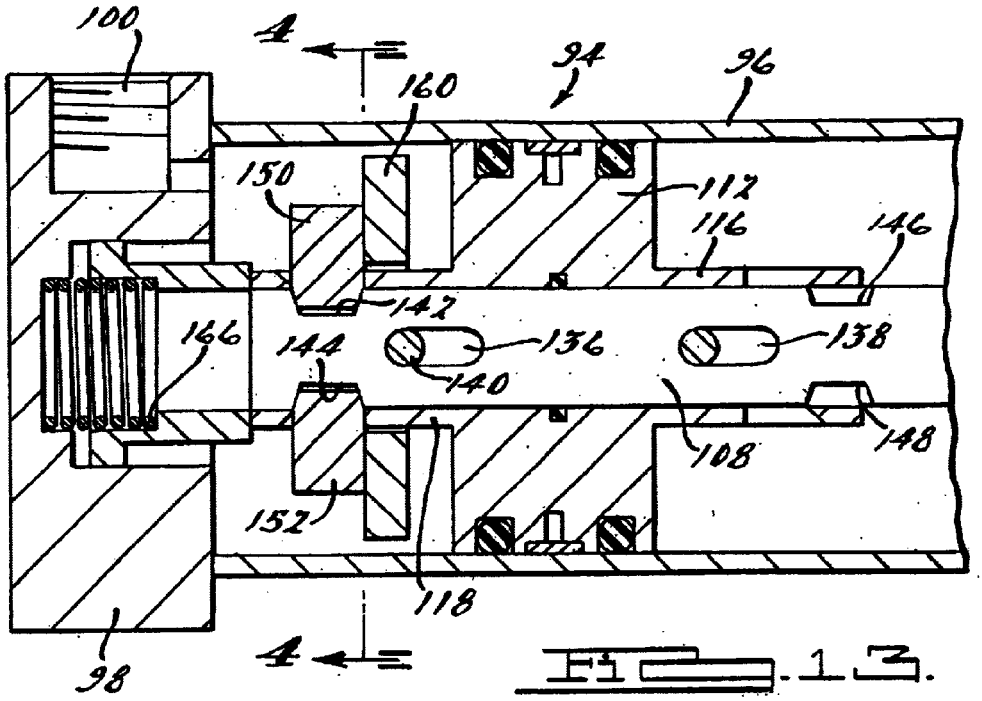
FIG. 13 shows a cross section of the cylinder locking device of FIG. 11 locked in the back end or fully retracted position.
Figure 16:
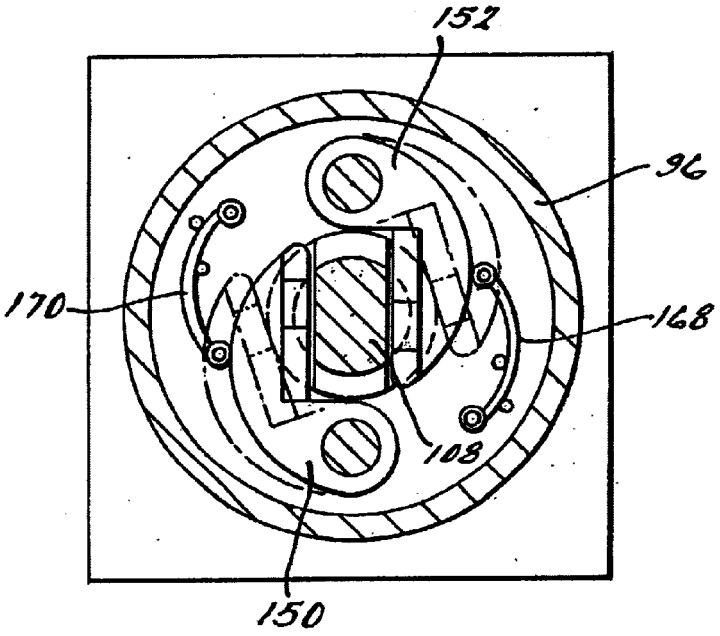
FIG. 16 shows an end view of a cross section of the second embodiment of the locking device.
Figures 14, 15:
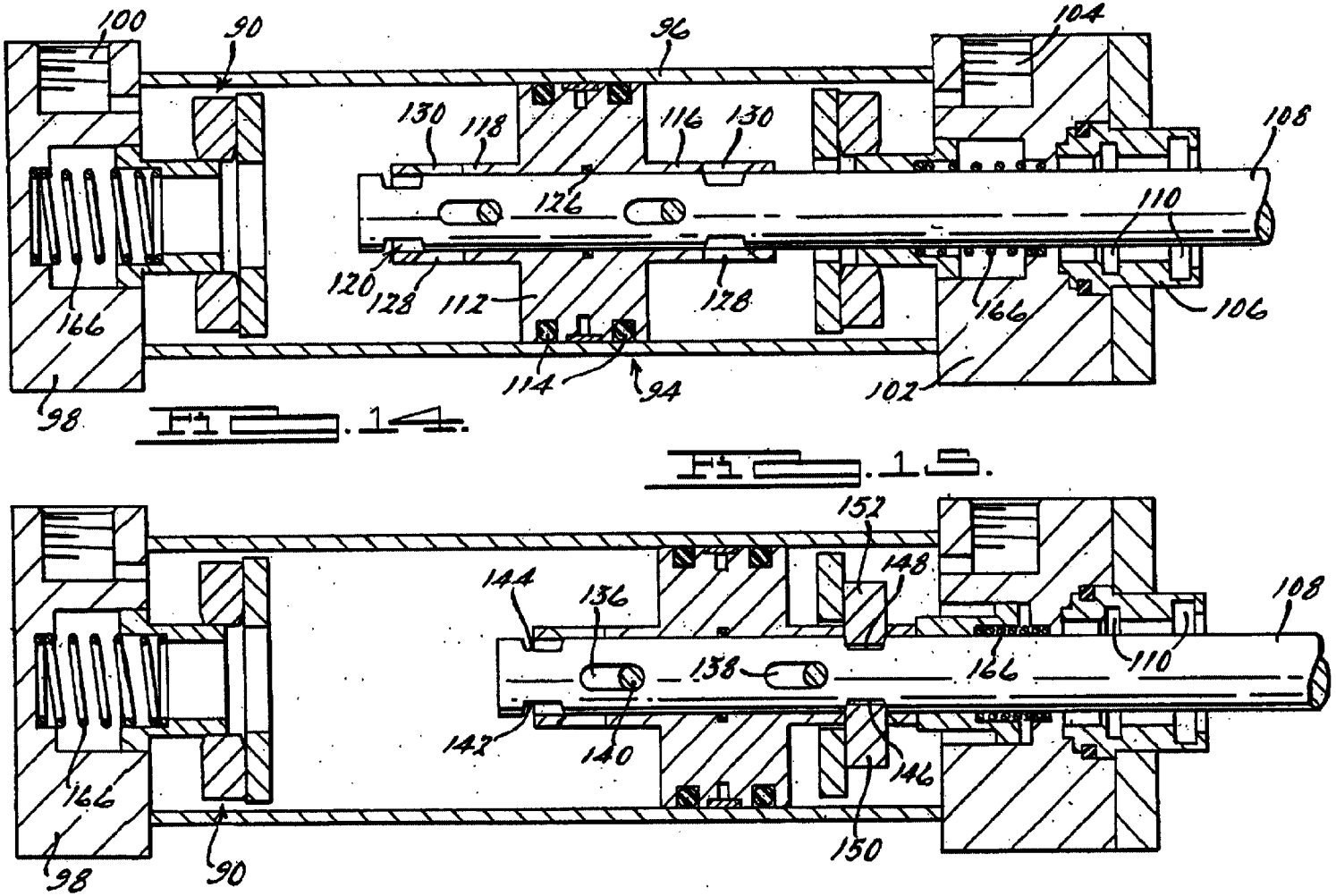
FIG. 14 shows a cross section of the second embodiment of the cylinder locking device in a neutral position.
FIG. 15 shows a cross section of the second embodiment with the locking device locked in the top end position.
Figure 17:
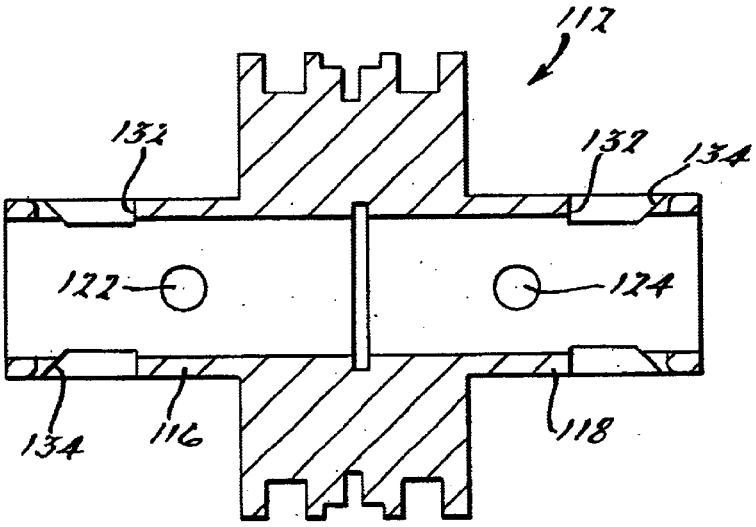
FIG. 17 shows a cross section of the piston according to the second embodiment of the locking device.
Figure 18:
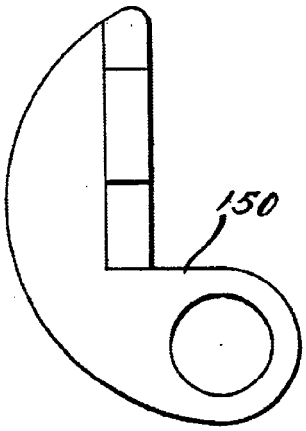
FIG. 18 shows a top view of the locking member according to the second embodiment.
Figure 19:
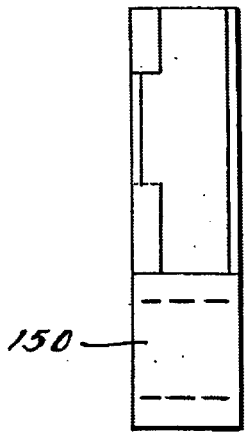
FIG. 19 shows a side view of the locking member according to the second embodiment.

In operation the second embodiment will operate the same as that described for the first embodiment in that pressurized fluid or air will move the piston 112 into either a fully retracted position or a fully engaged position depending on the work being done in the clamping environment. As shown in FIG. 13 the dual locking cylinder 94 is in its fully retracted position. In this position air has been applied to the pneumatic orifice 104 in the second end cap 102 and has created a greater pressure on the side of the piston 112 facing the second end cap 102 and has moved the piston rod 106 until it engages with and is locked by the first locking system 90 in the cylinder 94. When the locking process begins to occur the piston sleeve 118 will engage with the top end of the plunger 162 and will start moving the plunger 162 in an axial direction towards the first end cap 98. The plunger 162 will be moved within a bore of the first end cap 98. The angled surface of the first 150 and second locking arm 152 as shown in FIGS. 18 and 19 will next engage with the predetermined angled surface 134 on one end of the piston sleeve 118. This will allow the locking arms 150, 152 to begin a radially inward motion along the angled surface 134 of the piston sleeve 118. This radial inward motion will occur until the first and second locking arms 150, 152 are completely within and engaged with the first and second notch 142, 144 of the piston rod 108. The first 142 and second notch 144 of the piston rod 108 will lock with a surface of the first 150 and second locking arm 152 to create a shoulder lock type mechanism which will hold the piston rod 108 at its fully retracted position even when and if pneumatic pressure is lost within the cylinder 94. The force of the springs 168, 170 will keep the locking arms 150, 152 within the locking notches 142, 144 of the piston rod 108 and allow for no movement of the piston rod 108 while the clamp is off or in an idle position.

When the operator of the clamp wants to put the clamp in the fully engaged position, fluid or gas, in this embodiment air, will be introduced through the pneumatic orifice 100 of the first end cap 98 and will create a pressure on that end of the cylinder and start moving the piston 112 in an axial direction towards the second end cap 102. Thus, initially the piston 112 will start moving, along with the piston sleeve 116, 118, but the piston rod 108 will not start moving until the pin 140 engages the opposite end of the oblong channel 136. The angled surface 134 of the piston sleeve 118 will engage and interact with the angled surfaces of the first 150 and second locking arms 152 and force the locking arms 150, 152 in a radially outward direction. While the sleeve 118 is moving the plunger 162 will simultaneously, because the plunger 162 and sleeve 118 are in end to end contact, begin an axial movement towards the second end cap 102. When the locking arm 150, 152 is clear of the outer surface of the piston rod 108, via the angled surfaces interacting with one another between the piston sleeve 118 and first 150 and second locking arm 152, the piston rod 108 will begin its movement towards the fully engaged position. When the sleeve 118 separates from the first 150 and second locking arm 152 the plunger 162 will have made contact with the first 150 and second locking arm 152 and hold the first 150 and second locking arms 152 in a semi-open position awaiting the next fully retracted mode for the cylinder 94.

As the piston 112 slides across the cylinder 94 the same interaction will occur between the first 128 and second orifices 130 on the opposite side of the piston sleeve 116 and the first 150 and second locking arms 152 in the second locking system 92. The predetermined angled surfaces 134 of the piston sleeve 116 will interact with the predetermined angled surfaces on the locking arm 150, 152. This will also begin the movement of the plunger 162 into a retracted axial position while the locking arms 150, 152 are moved into a radially inward locked position. The locking arms 150, 152 will interact with the third 146 and fourth notches 148 located on the piston rod 108. When the first 150 and second locking arms 152 are secured via the locking shoulder type mechanism with the third 146 and fourth notches 148 on the piston rod 108. The cylinder 94 and hence clamp or pivot unit device will be locked in its fully engaged position, ie. when the piston rod third 146 and fourth notches 148 are directly parallel to or across from the first 150 and second locking arm 152. This will provide complete locking of the cylinder 94 in the fully engaged position and even if hydraulic pressure is lost to the clamp environment the piston rod 108 and hence cylinder 94/clamp will remain in its locked position.

To disengage the fully engaged position air, gas or fluid pressure will be introduced to the hydraulic orifice 104 in the second end cap 102 and thus will create air pressure which will move the piston 112 and piston sleeve 116, 118 without moving the piston rod 108. This movement of the piston sleeve 116 relative to the piston rod 108, will allow for engagement of the angled surface 134 of the orifice of the piston sleeves 116 with the angled surface of the first 150 and second locking arms 152 thus moving the locking arms 150, 152 in a radially outward position to allow for complete and free clearance of the locking arms 150, 152 from the piston rod 108. Then the piston rod will engage after the length of the oblong channel 138 has been traversed by the piston sleeve 116 and piston 112. This axial movement is towards the first end cap 98. The plunger 162 will also move in an axial direction toward the first end cap 98 and will engage with the first 150 and second locking arms 152 to keep the first 150 and second locking arms 152 in a non-equilibrium standby position.

It should be noted that the locking system 90, 92 can be used on both ends or on either end alone. The use of the locking system 90, 92 on both the back end and top end of the cylinder 94 will allow for the clamp or arm connected to the clamp to be in a locked position during shut down of the manufacturing operation such that injuries cannot occur if a person accidentally holds or relies on the clamp arm for support. In the fully engaged position the cylinder lock 90, 92 will also lock which will allow for secure holding of the part being worked on even if a power failure disables the hydraulic system. It should further be noted that the present invention uses only a first 100 and second hydraulic orifice 104 to operate both the piston 112 and clamping device and the cylinder locking system 90, 92 on either end of the cylinder. Generally prior art systems would have to include a second hydraulic system to operate the locking device separate from the hydraulic system operating the clamp and pistons. Therefore, the main piston 112 in the present invention is responsible for the unlocking and locking of both ends of the cylinder 94. It should be noted that in the present embodiment most of the parts are made from metal material but that any other material can be used depending on the requirements of the clamping environment. These materials may be but are not limited to hard plastics, hard ceramics, along with the aluminum or steel generally used in the embodiments. It should be noted that the oblong channel in both the first and second embodiment generally are anywhere between one eighth of an inch up to three quarters of an inch but in most of the embodiments it is generally one quarter of an inch, which allows for the relative movement between the piston rod and the piston sleeve. The axial movement of the piston rod can be anywhere from a quarter of a inch up to several inches depending on the size of the cylinder and the work environment the cylinder is to be used within. It is contemplated to use a cylinder lock device in cylinders that have nothing to do with clamps wherein a rod just needs to be locked in any type of environment even those not known for hydraulic systems. The present invention will make a more low cost clamp available that is capable of locking on both the fully engaged and fully retracted position and does not need extra hardware or packaging space to operate the locking device.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention maybe practiced otherwise then as specifically described.

What is claimed is:

1. A cylinder lock, said lock including:

a rod, said rod having a channel located near one end thereof;

a sleeve arranged around said rod;

a circular disk having an orifice therethrough, said sleeve secured within said orifice;

at least one locking member attached to or near said circular disk on one side thereof, said locking member interacts with said rod when said rod is in a locked position.

2. The lock of claim 1 wherein said rod slides within said sleeve a predetermined distance.

3. The lock of claim 1 wherein said locking member engages with said channel of said rod to lock said rod.

4. The lock of claim 1 further including a spring in contact with said locking member.

5. A cylinder lock, said lock including:

a rod, said rod having an angled surface extending from a surface thereof;

a sleeve arranged around said rod;

a circular disk having an orifice therethrough, said sleeve secured within said orifice;

at least one locking member attached to or near said circular disk on one side thereof, said locking member interacts with said rod when said rod is in a locked position.

6. A cylinder lock, said lock including:

a rod;

a sleeve arranged around said rod;

a circular disk having an orifice therethrough, said sleeve secured within said orifice;

at least one locking member attached to or near said circular disk on one side thereof, said locking member interacts with said rod when said rod is in a locked position; and a guide rail in contact with said circular disk.

7. A cylinder lock, said lock including:

a rod;

a sleeve arranged around said rod, said sleeve having at least one notch located at one end thereof;

a circular disk having an orifice therethrough, said sleeve secured within said orifice;

at least one locking member attached to or near said circular disk on one side thereof, said locking member interacts with said rod when said rod is in a locked position.

8. The lock of claim 7 wherein said notch having a shoulder portion.

9. A cylinder lock, said lock including:

a rod, said rod having at least one oblong orifice arranged therethrough, said orifice having a predetermined length;

a sleeve arranged around said rod;

a circular disk having an orifice therethrough, said sleeve secured within said orifice;

at least one locking member attached to or near said circular disk on one side thereof, said locking member interacts with said rod when said rod is in a locked position.

10. A cylinder, said cylinder including:

a body;

a first end cap on one end of said body;

a second end cap on one end of said body opposite said first end cap;

a piston and a piston rod arranged within said body, said piston having a sleeve extending from each end thereof, said sleeve having a notch on each end thereof, said notch having a radially extending wall on one side thereof and a predetermined angled wall on the opposite side;

a first locking device adjacent to said first end cap; and a second locking device adjacent to said second end cap.

11. The cylinder of claim 10 wherein said sleeve having a second set of orifices.

12. The cylinder of claim 11 wherein said piston rod having a first and second notch at predetermined positions.

13. The cylinder of claim 12 wherein said piston rod having a channel therethrough.

14. The cylinder of claim 13 wherein said piston rod is secured to said piston by a pin, said pin is in contact with said channel of said piston rod and said second set of orifices of said sleeve, said piston rod axially moves with respect to said sleeve a predetermined distance.

15. A cylinder, said cylinder including:

a body;

a first end cap on one end of said body;

a second end cap on one end of said body opposite said first end cap;

a piston and a piston rod arranged within said body;

a first locking device adjacent to said first end cap;

a second locking device adjacent to said second end cap;

said first and second locking device includes:

a mounting plate;

at least one locking arm rotatably mounted to said plate;

a spring in contact with said plate and said locking arm; and a plunger capable of axial movement relative to said locking arm.

16. The cylinder of claim 15 wherein said piston rod is locked in a full retract position when said piston rod engages with said locking arm of said first locking device.

17. The clamp of claim 15 wherein said piston rod is locked in a full engaged position when said piston rod engages with said locking arm of said second locking device.

18. A clamp, said clamp including:

a cylinder member;

a first end cap on one end thereof;

a second end cap on another end thereof;

a piston arranged within said cylinder member;

a piston rod engaged with said piston, said piston rod capable of axial movement with respect to said piston;

a plunger contacting to said second end cap;

a spacer contacting said second end cap and said plunger;

at least one locking arm contacting said spacer; and a mounting plate contacting said locking arm.

19. The clamp of claim 18 further including a fastener secured between said mounting plate and said second end cap.

20. The clamp of claim 18 further including a second locking arm adjacent to said first locking arm.

21. The clamp of claim 18 further including a second locking device contracting said first end cap, said second locking device including a plunger contacting said first end cap, a spacer contacting said first end cap and said plunger, at least one locking arm contacting said spacer, and a mounting plate contacting said locking arm.

22. The clamp of claim 18 further including a spring in contact with said plunger and said second end cap.

23. The clamp of claim 18 further including a second spring mounted between said mounting plate and said locking arm.

24. The clamp of claim 18 wherein said piston having a first and second sleeve extending from a first and second end thereof, said sleeves having a first orifice therein and a plurality of second orifices therethrough.

25. The clamp of claim 24 wherein said piston rod having at least one notch therein and at least one oblong orifice through a diameter of said piston rod.

26. The clamp of claim 25 further including a pin, said pin connects said piston rod to said piston sleeve by said second orifice and said oblong orifice.

27. The clamp of claim 26 wherein said first orifice of said sleeve aligns with said notch of said piston rod.

28. The clamp of claim 27 wherein the clamp locks in a full engage position when said locking arm interengages with said notch on said piston rod.

29. The clamp of claim 18 wherein said plunger engages and holds said locking arm in an open position when the clamp is in a full retract position.

* * * * *